United States Patent [19]

Masuda

[11] 4,210,949

[45] Jul. 1, 1980

[54] DEVICE FOR ELECTRICALLY CHARGING PARTICLES

[76] Inventor: Senichi Masuda, No. 605, 1-40-10 Nishigahara, Kuta-ku, Tokyo, Japan

[21] Appl. No.: 938,370

[22] Filed: Aug. 31, 1978

[30] Foreign Application Priority Data

Sep. 5, 1977 [JP] Japan ..... 52-106400
Dec. 15, 1977 [JP] Japan ..... 52-150937

[51] Int. Cl.[2] ..... H05B 5/02
[52] U.S. Cl. ..... 361/226; 361/227; 361/235
[58] Field of Search ..... 361/226, 227, 229, 230, 361/235

[56] References Cited

U.S. PATENT DOCUMENTS

| | | | |
|---|---|---|---|
| 3,237,068 | 2/1966 | Sowiak | 361/235 |
| 3,337,784 | 8/1967 | Lueder | 361/235 X |
| 4,029,995 | 6/1977 | Itoh | 361/226 |

FOREIGN PATENT DOCUMENTS

| | | | |
|---|---|---|---|
| 442584 | 6/1972 | U.S.S.R. | 361/226 |

*Primary Examiner*—Harry E. Moose, Jr.
*Attorney, Agent, or Firm*—Steinberg and Blake

[57] ABSTRACT

In a device for electrically charging particles, a pair of parallel plasma generators are spaced from one another, each of the generators having corona discharge electrodes. A main field forming source of high AC voltage is connected between the plasma generators, to form a main field in the charging space, and intermittently operating corona generating high voltage power sources are coupled to apply high voltages to the respective corona discharge electrodes only when the plasma generators have relative specific polarity, whereby only particles of one polarity are driven into the charging space. The intermittent corona generating high voltage source has a frequency equal to or greater than the frequency of the AC voltage which provides the main AC field.

9 Claims, 18 Drawing Figures

FIG. 1
PRIOR ART
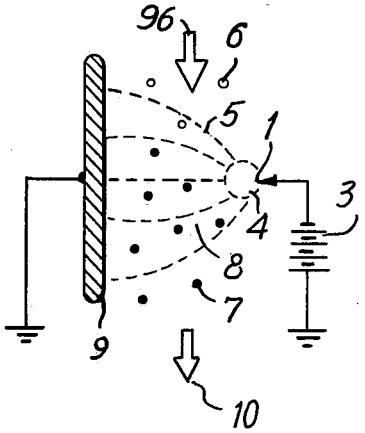
FIG. 2
PRIOR ART
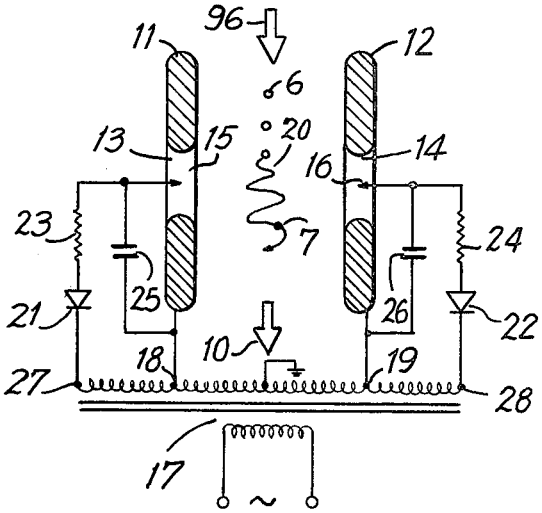
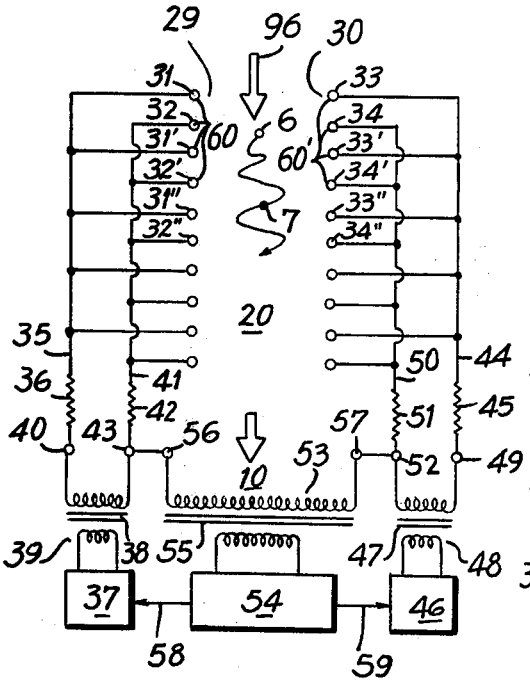
FIG. 3
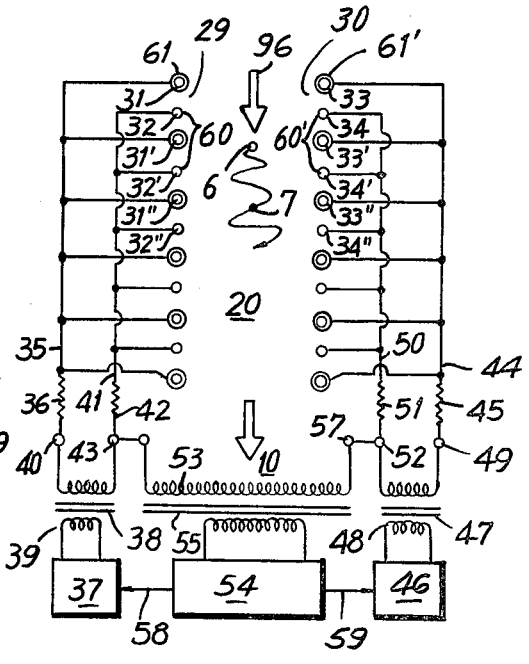
FIG. 4

FIG. 5
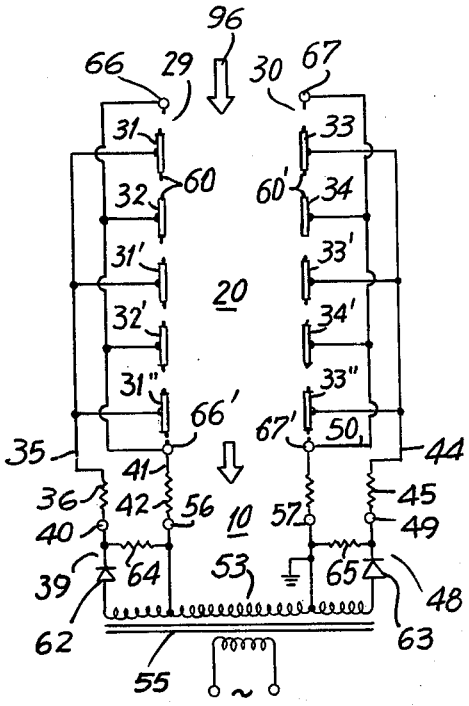
FIG. 6
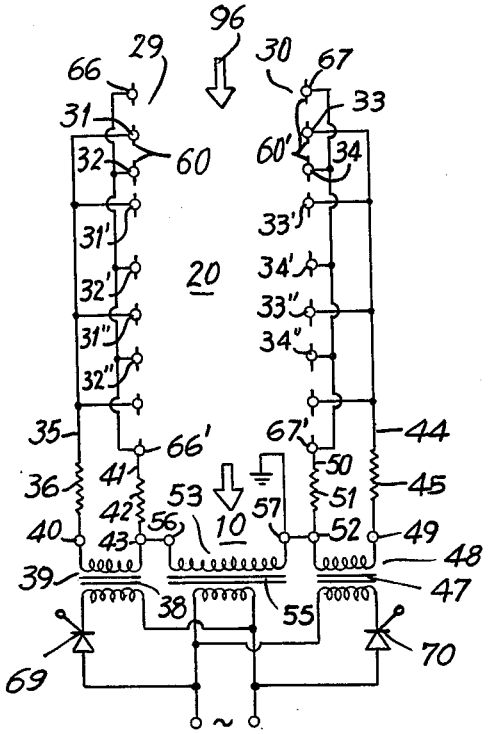
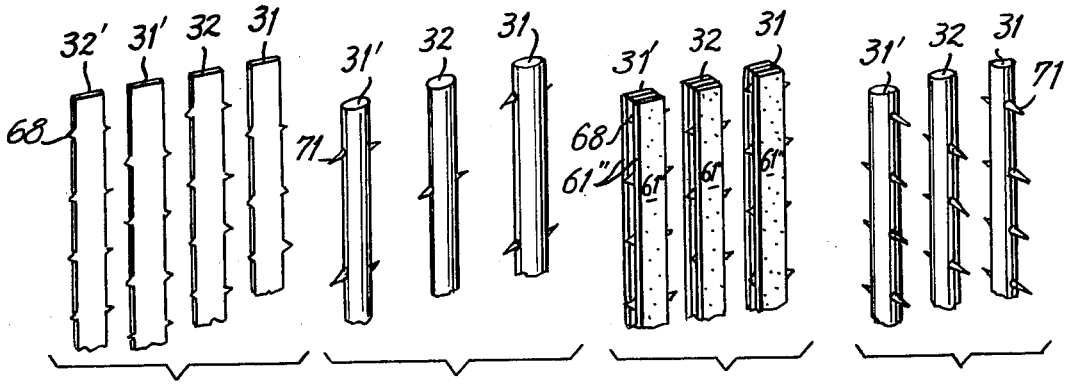
FIG. 7A FIG. 7B FIG. 7C FIG. 7D

FIG. 8
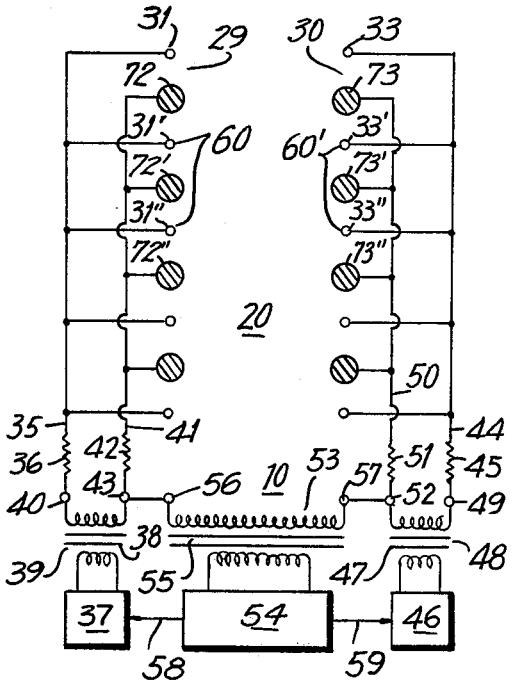
FIG. 9
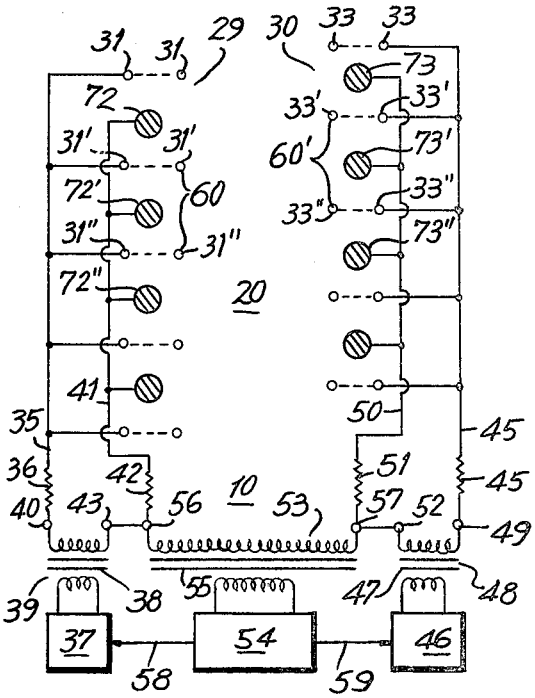
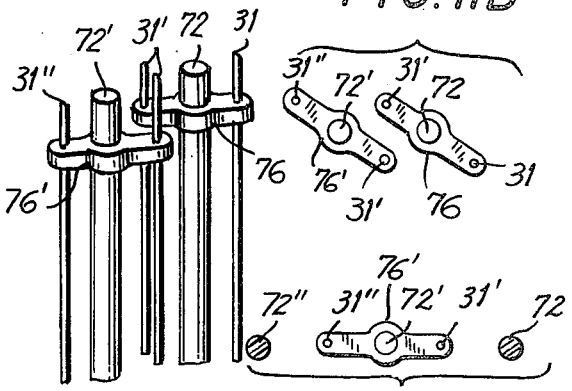
FIG. IIB
FIG. IIC
FIG. IIA
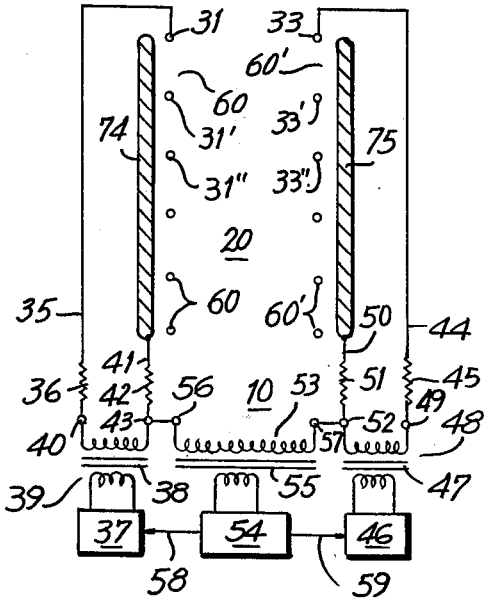
FIG. 10

DEVICE FOR ELECTRICALLY CHARGING PARTICLES

BACKGROUND OF THE INVENTION

This invention is directed to particle charging devices, and is more particularly concerned with devices of this type having two or more parallel generators for defining a main field, the generators including corona discharge electrodes.

FIG. 1 of this application discloses generally the concept of charging particles by a corona discharge process.

In order to electrically charge solid fine particles, as well as for contact charging and friction charging processes which do not require any special charging device, the form of a charging device illustrated in FIG. 1 is comprised of a needle-like or linear corona discharge electrode 1, a plate-like, cylindrical or circular opposite electrode 2, and a DC power source 3, as shown in FIG. 1. The DC corona discharge 4 enables the bombardment and adhesion of the ions 5 caused by the corona discharge onto solid fine particles 6 in corona space 8. This known method has the great disadvantage that the magnitude of charging quantity received by particles cannot be clearly determined, and therefore the control of the quantity of charged particles is technically difficult. In the method of using corona discharge as shown in FIG. 1 there is a clear quantitative relationship that the saturation charge on charged particles 7 is generally proportional to the square of particle diameter and to the field intensity of charging area. The charged particles 7 are driven by the coulomb force from the corona discharge electrode 1 to the opposite electrode 2. This method has the disadvantage that particles with large charges adhere to the surface 9 of the opposite electrode and are not supplied to the intended working area 10, while only particles with small charges are supplied to area 10.

In order to overcome the disadvantage, I have disclosed in Japanese Patent Application No. 71-50087, filed July 7. 1971, a method of the type, for example, shown in FIG. 2 of the present disclosure, wherein alternating electrodes 11 and 12 are positioned parallel to one another at a determined spacing. The electrodes, are insulated from one another, small holes or fine openings 13 and 14 respectively are provided in the alternating electrodes and discharging 3rd electrodes 15 and 16 respectively are provided in the centers of the holes or openings. The electrodes 15 and 16 are insulated from the alternating electrodes. An alternating voltage is applied between said alternating electrodes 11 and 12, for example, by the secondary winding terminals 18 and 19 of a transformer 17, to form an alternating field in the charging space 20 between the electrodes. An alternating voltage is also supplied, as illustrated, to the discharging 3rd electrodes 15 and 16, for example by the secondary winding terminals 27 and 28 of transformer 17 connected to rectifiers 21 and 22, series resistances 23 and 24 parallel capacitors 25 and 26. In the arrangement illustrated in FIG. 2, when the alternating electrode 11 has a sufficiently high negative voltage, spark discharge is generated repetitively only between this electrode and the 3rd electrode 15. At this time, no discharge occurs between electrodes 12 and 16. The spark discharge generates plasma containing both positive and negative ions between both the electrodes, and of these, the negative ions are emitted into the charging space 20 from left to right for the bombardment charging of solid fine particles 6. When the electrode 12 has a sufficiently high negative voltage, with the polarity reversed, negative ions are emitted into the charging space 20 from right to left in accordance with the above discussed principle, for the same bombardment charging of the particles, so that large charges, negative in this instance, are applied to the particles. The colomb force acting on the particles alternates to prevent adhesion of particles onto the electrodes.

However, while the above arrangement is structurally very simple, it has been found to have a disadvantage that, when the atmosphere contains combustible gas or combustible powder, the energy of the spark discharge generated repetitively between discharging 3rd electrodes and alternating electrodes may cause ignition.

In a modification of the concept of the above system, my Japanese patent application no. 48-100901, filed in Japan on Sept. 7, 1973, discloses a system wherein corona discharge is employed, instead of the arc discharging of the former apparatus. The system of this latter disclosure, however, only employs a single corona discharge electrode for each generator. U.S. Pat. No. 4,029,995, based upon Japanese patent application No. 49-78222, filed in Japan on July 10, 1974, discloses a modification of the first two disclosed systems, wherein the generating means comprises planar electrodes each including a plurality of corona discharge electrodes. In the system of Itoh, however, the corona discharge voltage and the main field supply voltage are continuous AC voltages. As a consequence, in accordance with the concept of this reference, it is necessary to provide complex phase shifters for shifting the phase between the plasma producing voltages. In addition, it is necessary to provide a source of voltage for producing the main field that is twice as high as the frequency of the voltage for producing the plasma.

The object of the present invention is to provide a very high performance alternating field type device for electrically charging particles overcoming the above disadvantages, and thus to provide an accurate and highly efficient device for electrically charging particles which is required for various electrodynamic fine particles control devices such as electrostatic precipitators and sorter transporters, and various electrostatic applied devices such as electrostatic hair planters and electrostatic sprayers.

Briefly stated, in the present invention, the above object is attained by using plasma sources arranged substantially in planes, and by employing corona discharge free of ignition or corona discharge through insulators, instead of employing a plasma source with repetitive spark discharge.

The device for electrically charging particles, in accordance with the present invention, comprises two or more parallel plane plasma generating means arranged opposite to one other at a determined spacing as if to hold introduced particles from both sides. The generating means have corona discharge electrodes, and corona generating high voltage power sources as provided for applying a high voltage alternately to the corona discharge electrodes of said respective plane plasma generating means in order to generate corona discharge. A main field forming AC high voltage power source is provided for applying an AC high voltage between the opposing plane plasma generating means, to form an AC main field in the charging space therebetween. The sources are controlled so that a voltage is applied from the corona generating AC high voltage power source to the respective plasma generating means to generate corona discharge, and thereby to generate plasma corona discharge alternately in the adjacent region, only when the plane plasma generating means have a specific polarity. Thereby unipolar ions of this polarity are alternately emitted from the opposing plane plasma generating means into the charging space therebetween, to charge the particles introduced into said charging space, by alternate bombardment by said unipolar ions from both sides in the AC field.

Remarkable action effects can be attained by this arrangement. The particles concerned can be charged perfectly up to a theoretically determined saturation point, with the possibility of ignition completely suppressed even in the presence of combustible gas or combustible powder in the atmosphere. The total amount can be supplied to the working area without adhering to electrodes. In addition, there is a further excellent effect that, since plasma containing positive and negative ions and bipolar ion atmosphere are generated periodically in said plasma generating means, unipolarly charged particles with high electric resistance, if adhering to the component electrodes, are discharged immediately, so that the charging effect is not hindered by generation of inverse ionization.

The system of the present invention thereby utilizes a principle that is entirely different from that of the Itoh reference. Instead of the two continuous AC voltages as employed in the prior art, the system of the present invention employs interrupted AC voltages which are turned on when the corresponding plane electrode has a determined polarity. As a consequence, the switching excitation is simpler and more economical, and does not require the use of an expensive phase shifter and difficult adjustment of such a phase shifter. In addition, in accordance with the invention the main field may be produced by voltages of the mains frequency, and so may be derived much more easily than in the system of this reference. Further, considerable flexibility is obtained by not limiting the relative frequencies of the voltages, as in the arrangement of Itoh.

BRIEF FIGURE DESCRIPTION

In order that the invention will be more clearly understood, it will now be disclosed in greater detail with reference to the accompanying drawings, wherein:

FIG. 1 is a simplified showing of one form of prior art charging device;

FIG. 2 is a simplified diagram of another form of prior art charging device;

FIG. 3 is a simplified circuit diagram of a particle charging device in accordance with one embodiment of my invention;

FIG. 4 is a circuit diagram of a modification of the system of FIG. 3;

FIG. 5 is a circuit diagram of still another modification of the circuit of FIG. 3;

FIG. 6 is a circuit diagram of a still further modification of the circuit of FIG. 3;

FIGS. 7A–7D are respective views of portions of the discharge generating means that may be employed in the systems of the invention, for producing corona;

FIGS. 8, 9 and 10 are simplified diagrams of additional embodiments of modifications of the system of FIG. 3;

FIGS. 11A–11C are illustrations showing configurations of corona discharge electrodes which may be employed, for example, in the arrangements of FIGS. 8 and 9;

DETAILED DISCLOSURE OF THE INVENTION

Figure 13:
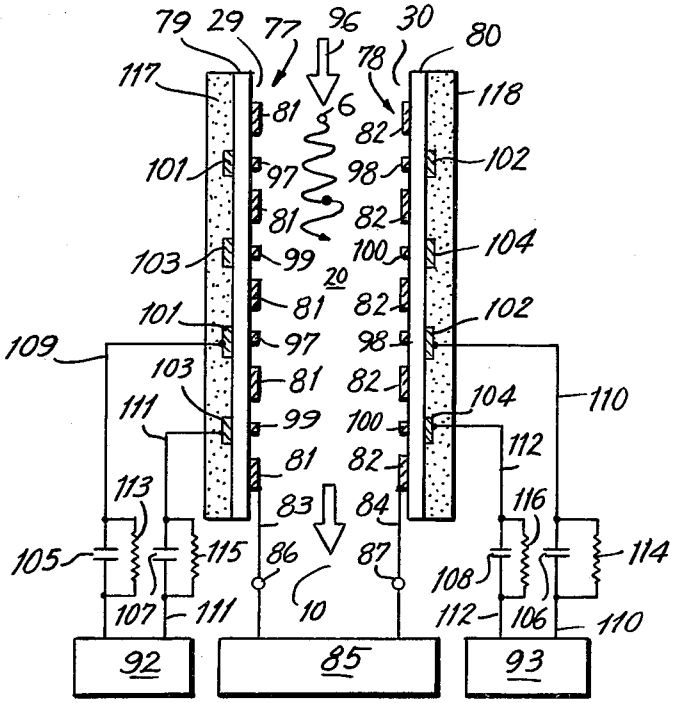
FIGS. 12 and 13 are simplified illustrations showing further modifications of the system of the invention as shown in FIG. 3, wherein inductive electrodes are provided.

Referring now to the drawings, and more particularly to FIG. 3, therein is shown a block diagram of one embodiment of the present invention. In the drawing, symbols 29 and 30 are a pair of parallel plane plasma generating means arranged opposite to one another, and insulated from one another. In this example, each plasma generating means comprises two groups of linear discharge electrodes 31,31', 31'', . . . and 32,32' 32'', . . . or 33,33',33'', . . . and 34,34', 34'', . . . arranged adjacent to each other on a plane in parallel at equal intervals, and insulated from each other. Of these 31,31',31'', . . . are connected through a common conductor 35 and a protective resistance 36, to one output terminal 40 of one corona generating AC high voltage power source 39 consisting of an AC power source 37 and a step-up and intermittently operating insulating transformer 38.

Electrodes 32,32',32'', . . . are connected through a common conductor 41 and a protective resistance 42, to the other terminal 43 of said power source 39. Electrodes 33,33', 33'', . . . are connected through a common conductor 44 and a protective resistance 45, to one output terminal 49 of the other corona generating AC high voltage power source 48 consisting of an AC power source 46 and intermittently operating step-up and insulating transformer 47. Electrodes 34,34',34'', . . . are connected to the other output terminal 52 of power source 48 through a common conductor 50 and a protective resistance 51. Symbol 53 is a main field forming AC high voltage power source for forming the AC main field in the charging space 20 between the pair of plane plasma generating means 29 and 30, and consists of an AC power source 54 and a step-up transformer 55. Transformer output terminals 56 and 57 are connected to terminals 43 and 52 respectively. By this arrangement, an AC high voltage is applied to the plane plasma generating means 29 and 30, to form the AC main field in the charging space 20. Furthermore, conventional control means are provided so that a signal is sent through the conductor 58,59 to the AC power source 37,46, to operate the AC power source 37,46, generating an AC high voltage, only when the output terminal 56,57 has a specific polarity, for example, positive polarity.

Therefore, if said plane plasma generating means 29 has for example positive polarity with respect to generating means 30, a high frequency AC high voltage is applied between adjacent two groups of linear discharge electrodes 31,31',31'' . . . and 32,32',32'', . . . constituting the plasma generating means 29 from said corona generating AC high voltage power source 39. The discharge electrodes of both the groups thereby supply positive and negative ions by high frequency AC corona discharge, to form a bipolar ion atmosphere of ions of both positive and negative polarities along them in the adjacent areas, and to form plane-like plasma 60 in the corona discharge section. At this time, by the rightward directed action of main field from 29 to 30, only positive ions are driven from said plasma into the charging space, to the right, to bombard particles 6 introduced there-in from above, to charge the particles. In this case, since the AC power source 46 is not provided an operating signal by the conductor 59, the AC power source 46 does not operate, and therefore does not apply a high frequency AC high voltage between the adjacent groups of linear discharge electrodes 33,33',33'', . . . and 34,34',34'', . . . . These electrodes constitute the other plane plasma generating means 30 and now have a negative polarity so that they do not generate high frequency AC corona discharge, and do not drive plasma between the groups of discharge electrodes. As a result, negative ions cannot be drawn from the plane plasma generating means 30 by the action of main field into the charging space 20, to decrease the positive charges given to the particles. When the polarities of generating means 29 and 30 are reversed, the above operation is completely reversed, and this time, only plane plasma generating means 30 of positive polarity forms plasma 60', to supply positive ions leftward into the charging space 20, and generating means 29 does not form plasma. Thus, the field of charging space 20 is periodically alternated toward left and right, and always only positive (or negative) unipolar ions shuttle in the space. The particles 6 in this example are bombarded alternately from left and right by ions of positive polarity, and are promptly charged to a theoretically determined saturation point, and drop downward as charged particles 7 in the charging space by gravity or the action of air current in the direction of the arrow. The particles are vibrated by the alternating field without adhering to the electrodes, to be supplied to the working area 10. The waveform of voltage supplied by the main field forming AC high voltage power source 53 used in the present invention can be sinusoidal, or any other desired form, but a rectangular wave-form is preferred in order to improve the charging rate. The frequency can be commercial mains frequency, but if necessary, any lower or higher frequency can be used. Furthermore, the waveform of voltage supplied by the corona generating AC high voltage power sources 39 and 48 can be sinusoidal, rectangular, triangular, pulse or any other desired form. The frequency can be the same as the frequency of the power source 53, but any higher frequency can be used, to greatly improve the ion generating capability. The power sources 39 and 48 can be separate from the power source 53, or they can comprise a common element as shown in the embodiment of FIG. 5. The corona generating AC high voltage power sources 39 and 48 and the main field forming AC high voltage power sources 53 can have their output terminals connected directly by protective resistances, etc. to said plane plasma generating means 29 and 30 as shown in the embodiment of FIG. 3, but depending on the situation, they can be obviously connected further by coupling capacitors. The corona generating high voltage power sources can be AC power sources as in the case of 39 and 48 of this example, but depending on the situation, they can alternatively be DC power sources.

Figure 12:
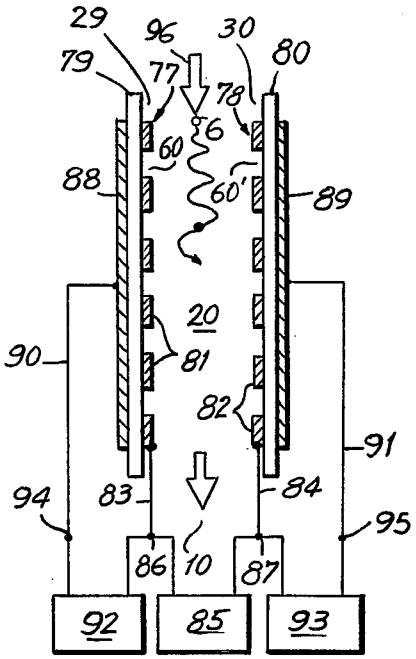

Each of the plane plasma generating means 29 and 30 comprises two groups of adjacent corona discharge electrodes in the embodiment of FIG. 3, and in this case, when an AC voltage is supplied from the power source 39 or 48 between the groups of electrodes, every set of electrodes produces corona discharge, to supply both positive and negative ions in the vicinity thereby forming plane plasma. However, depending on the situation, as shown in the embodiment of FIG. 4, one group of electrodes constituting said plane plasma generating means 29 or 30 can be covered partially or entirely with an insulator layer. Alternatively, as shown in the embodiment of FIG. 12, an inductive electrode may be provided close by, opposite to the corona electrodes and spaced by an insulator, to induce corona discharge. By such arrangement, with spark generation suppressed, the spacings between electrodes of both the groups can be reduced considerably. In the former case, if the covering is provided entirely, the electrodes not covered must be arranged as discharge electrodes to produce corona discharge, but the covered electrodes can be non-corona electrodes with large radii of curvature. As shown in the embodiments of FIGS. 8, 9 and 10, one group out of the two groups of electrodes constituting each plasma generating means 29 or 30 can be non-corona discharge electrodes not covered with an insulator. In this case, the other electrodes opposing them should be designed as discharge electrodes for producing corona discharge. However, as in the case of the embodiments of FIGS. 4 to 10, if insulator-covered electrodes or non-corona electrodes are combined with corona discharge electrodes, to constitute each plasma generating means, and plasma with discharging effect (inverse ionization preventing effect) is formed there, then the corona discharge electrodes must supply positive and negative ions by AC corona discharge. For this purpose, the power sources 39 and 48 must be AC power sources, with their frequency higher than the frequency of the power source 53. In this case, in order to definitely prevent the generation of corona discharge by the corona discharge electrodes when no voltage is supplied from the power sources 39 or 48 concerned, a DC bias power source may be inserted in series with each of said power sources 39 and 48, to give a DC bias voltage. The discharge electrodes constituting the plane plasma generating means 29 and 30 are not necessarily always linear, but can be strips with knives (FIG. 5), strips with protrusions (FIGS. 7A and 7C), bars with protrusions (FIG. 6, FIGS. 7A and 7D) or wires with star or square section, or any other desired form. When one group of the electrodes constituting said plane plasma generating means comprises non-corona electrodes, the corona discharge electrodes and non-corona electrodes can be arranged on a plane (FIG. 8), or zigzag (FIGS. 9 and 11), or in any combination thereof. Furthermore, as shown in the embodiment of FIG. 10, the non-corona producing electrodes may be arranged as a flat plate, with corona discharge electrodes arranged in parallel in front thereof. Furthermore, the electrodes constituting the plane plasma generating means 29 and 30 need not always be divided into two groups, but can be divided into 3 or more groups in the order of adjacent electrodes, depending on the situation, to employ a voltage using three-phase or multiphase corona generating AC high voltage power sources, for AC corona discharge. In this case, each output terminal of the main field forming the AC high voltage power source is connected to the neutral point or one output terminal of each of the corona generating AC high voltage power sources. Depending on the situation, air currents may be directed through the clearances between the respective electrodes constituting said plane plasma generating means 29 and 30, from their back sides into the charging space 20, thereby preventing the charged particles from entering the plasma region near said plasma generating means 29 and 30, to be discharged, or from adhering to the electrodes constituting the generating means 29 and 30, and removing particles adhering thereto. If the particles should adhere to the plasma generating means, they can be removed by mechanical impact by conventional methods or scraping by scrapers, to prevent the drop of discharge performance.

FIG. 4 is a block diagram of another embodiment of the present invention. In this embodiment, electrodes 31,31',31'', . . . and 33,33',33'', . . . of one of the groups in each of said plane plasma generating means in the embodiment of FIG. 3 are covered on their surfaces with insulating layers 61 and 61'. In this case the other electrodes 32,32', 32'', . . . and 34,34',34'', . . . are discharge electrodes for producing corona discharge, and the frequency of the corona generating AC high voltage power sources 39 and 48 for supplying an AC high voltage to the electrodes for forming plasma 60 is higher that the frequency of the main field forming AC high voltage power source 53 by one or more decimal places. By this arrangement, the groups of said discharge electrodes 32,32',32'', . . . and 34,34',34'', . . . produce high frequency corona discharge with group of said electrodes 31,31', 31'', . . . and 33,33',33'', . . . covered with an insulator 61 alternately and only when the generating means 29 or 30 has a specific polarity, to supply positive and negative ions in their vicinity and form plasma 60 or 60'. The names and functions of symbols 6 to 60' in FIG. 4 are the same as those of the same symbols in FIG. 3, and the particle charging operation in this example is the same as that in FIG. 3, and therefore is not described here. As mentioned already, in this example, the use of insulator coverings 60 and 60' allows a great reduction in space between the respective groups of component electrodes of plane plasma generating means 29 and 30, consequently improving the charging efficiency of the device.

FIG. 5 is a block diagram of a further embodiment of the present invention. In this example, the discharge electrodes 31,31',31'', . . . 32,32',32'', . . . and 33,33',33'', . . . and 34,34', 34'', . . . constituting said plane plasma generating means 29 and 30 are formed as strips. Each of the strip-formed electrodes has sharp knife edges at both its edges, to produce the corona discharge at these edges. Furthermore, in this example, the end windings of the secondary winding of the boosting transformer of the main field forming AC high voltage power source 53 are used in combination with rectifiers 62 and 63 and leakage resistances 64 and 65 connected in the illustrated direction in this example, as the corona generating AC high voltage power sources 39 and 48. The names and functions of symbols 10 to 60' in FIG. 5 are same as those of the same symbols in FIG. 3. Therefore, if the output terminal 56 of the power source 53 has a specific polarity, for example, positive polarity, the output terminal 40 of the power source 39 has positive polarity with respect to terminal 56, and a voltage is applied between the groups of component discharge electrodes 31,31',31'', . . . and 32,32',32'', . . . of said plane plasma generating means 29, to provide the former group of electrodes with a positive polarity. The former emits positive ions by positive corona discharge, and the latter emits negative ions by negative corona discharge, to form plasma 60 in the vicinity of the electrodes emitting positive ions into the charging space 20, and charging the particles. At this time, no potential difference appears between the output terminal 49 of the power source 48 and the terminal 57, by the action of rectifier 48 and leakage resistance 65. Therefore no corona discharge is generated and no plasma appears on said plane plasma generating means 30, and negative ions are not emitted to space 20. The leakage resistance 65 prevents the potential at the terminal 49 from rising with respect to the terminal 57 by the positive ion current passing through the charging space 20 into the group of discharge electrodes 33,33',33'', . . . , and, as a result causing corona discharge between said group of discharge electrodes and the group of discharge electrodes 34,34',34'', . . . . The leakage resistance 64 provides the same effect. When the polarity of main field forming AC high voltage power source 53 is reversed, the above operation is reversed, and only the plane plasma generating means 30 emits positive ions into the charging space 20, charging the particles. Symbols 66, 66' and 67, 67' are non-corona electrodes which prevent AC corona discharge from being generated by the action of the AC main field at the ends of said plane plasma generating means 29 and 30, and thereby supplying ions of reverse polarities to the inlet and outlet ends of charging space 20, and discharging the charged particles. In this example, each of the elements 66, 66',67,67' is a bar-shaped electrode with protrusions for corona discharge toward discharge electrodes 31 and 31'' or 33 and 33'' as illustrated.

FIG. 6 is a block diagram of a still further embodiment of the present invention. In this example, the component electrodes 31,31',31'', . . . 32,32',32'', . . . 33,33',33'', . . . 34,34',34'', . . . of said plane plasma generating means 29 and 30 are bar-shaped electrodes with needle-like protrusions toward mutually adjacent electrodes. Furthermore, in this example, the corona generating AC high voltage power sources 39 and 48 comprise step-up transformers 38 and 47 with primary windings connected through thyristors 69 and 70 to the power source common with the low voltage power source of the main field forming AC high voltage power source 53 as illustrated. Thyristors 69 and 70 conduct current only when the output terminals 56 and 57 of the main field forming AC power source 53 have a specific polarity, for example, positive polarity. The names and functions of symbols 10 to 67 in FIG. 6 are same as those of the same symbols in FIGS. 3 and 5. In this example, when the output terminal 56 has positive polarity with respect to ground reference 57, only the thyristor 69 conducts, and a high voltage appears between the terminals 40 and 43, to form plasma 60 only in the plane plasma generating means 29, from which positive ions are emitted into the charging space 20. The thyristor 70 does not conduct, and hence negative ions are not produced by generating means 30. With the polarity of power source 53 reversed, only thyristor 70 conducts, and the operation is reversed, to supply positive ions from generating means 30 to space 20, but negative ions are not supplied from generating means 29, thereby attaining the charging of particles in a positive polarity in space 20.

FIGS. 7A–7D shows various forms of corona discharge electrodes 31,32 ,31', . . . constituting the plane plasma generating means 29 and 30. FIG. 7A shows strip-shaped electrodes with discharge protrusions 68 on the respective edges faced by those of adjacent edges in zigzag positions. FIG. 7B shows bar-formed electrodes with needle-like discharge protrusions 71 faced by those of mutually adjacent electrodes in zigzag position. FIG. 7C shows the strip-shaped discharge electrodes of FIG. 7A, each with two strip-shaped insulation layers 61" fitted on both sides of it as if to hold it, for complete prevention of inverse ionization by adhering particles, and the discharge protrusions 68 are exposed. FIG. 7D shows the electrodes of FIG. 7B, but with the discharge protrusions 71 directed toward the charging space.

FIG. 8 is a block diagram of a still further embodiment of the present invention. In this example, non-corona cylindrical electrodes 72,72',72", . . . and 73,73',73", . . . with large radii of curvature are used, instead of electrodes 32,32',32", . . . and 34,34',34", . . . for the respective two groups of component electrodes of the plane plasma generating means 29 and 30. Adjacent to these electrodes are linear corona discharge electrodes 31,31',31", . . . and 33,33',33", . . . . The names and functions of symbols 10 to 60' in FIG. 8 are same as those of the same symbols in FIG. 3. In this example, the frequency of corona generating AC high voltage power sources is higher than the frequency of the main field forming AC high voltage power source by about one decimal point. In this arrangement, when plane plasma generating means 29 or 30 has a specific polarity, the discharge electrodes 31,31',31", . . . or 33,33',33", . . . belonging to it produce AC corona discharge toward the respective non-corona cylindrical electrodes 72,72',72", . . . or 73,73',73", . . . to alternately supply positive and negative ions, forming the plasma 60 and 60'. The particle charging operation of this arrangement is obvious and is hence not described here.

FIG. 9 is a block diagram of a still further embodiment of the present invention. In this example, the corona discharge electrodes 31,31',31", . . . and 33,33',33", . . . of the plane plasma generating means 29 and 30 in the embodiment of FIG. 8 are arranged in zigzag positions with respect to their adjacent non-corona cylindrical electrodes 72,72',72", and 73,73',73", . . . . In this arrangement, when charged particles with high resistance adhere to the non-corona electrodes, the inverse polar ions by the inverse polar corona discharge from said corona discharge electrodes reach the adhering particles more easily by way of the field, and as a result, the discharging of the adhering charged particles and the prevention of inverse ionization can be more easily effected. The names and functions of symbols 10 to 73" in FIG. 9 are same as those of the same symbols in FIG. 8. The particle charging operation of this embodiment is obvious and is hence not described here.

FIG. 10 is a block diagram of a still further embodiment of the present invention. In this embodiment, each one of non-corona sheet-shaped electrodes 74 and 75 is used instead of the non-corona cylindrical electrodes 72,72',72", . . . and 73,73',73", . . . of said plane plasma generating means 29 and 30 in the embodiment of FIG. 9, and the groups of corona discharge electrodes 31,31',31", . . . and 33,33',33", . . . are arranged in parallel in front of electrodes 74 and 75 at equal intervals, to constitute generating means 29 and 30. In this arrangement, the discharging of particles adhering to the non-corona electrodes 74 and 75, and therefore the prevention of inverse ionization, can be effected more perfectly. The names and functions of symbols 10 to 60' in FIG. 10 are same as those of the same symbols in FIG. 9. The particle charging operation of this embodiment is obvious, and is hence not described here.

In the embodiments of FIGS. 4,8,9 and 10, a bias voltage can obviously be applied between the group of said corona discharge electrodes and the opposing group of insulator-covered electrodes or non-corona electrodes.

FIG. 11 shows examples of arrangement of plane plasma generating means 29 in FIGS. 8 and 9. In FIG. 11A, the non-corona cylindrical electrodes 72,72', . . . are fixed with insulator brackets 76 and 76' shaped as illustrated, and the corona discharge electrodes 31,31',32", . . . are supported by the tips of the brackets, being suspended in parallel on both sides of the non-corona cylindrical electrodes 72 and 72' at equal intervals, and being insulated from them. If the direction of brackets 76 and 76' is turned by the same angle with respect to the plane of electrodes 72 and 72', in the relative position as shown in FIG. 11B, the relation between 31,31',31", and 72,72', . . . becomes zigzag as shown in FIG. 9. As shown in FIG. 11C, if the non-corona discharge electrode 72' with the bracket 76' and the corona discharge electrodes 31' and 32" of FIG. 11A are arranged between the non-corona cylindrical electrodes 72 and 72", then, 31,31',31", . . . and 72,72',72", . . . are positioned with their centers in one plane, as shown in FIG. 8.

FIG. 12 is a block diagram of a still further embodiment of the present invention, in which an inductive electrode is provided through an insulator near the corona discharge electrodes, to constitute each of said plasma generating means 29 and 30. Symbols 77 and 78 are corona discharge electrode groups, and in this example comprise many strip-shaped electrodes 81 and 82 which are bonded on insulating boards 79 and 80 and are respectively connected to one another and to the output terminals 86 and 87 of main field forming rectangular wave AC high voltage power source 85 by conductors 83 and 84, to produce a rectangular wave AC field in the charging space 20. Symbols 88 and 89 are inductive electrodes bonded on the back sides of the insulating boards 79 and 80, and each is connected to one output terminal 94 or 95 of corona generating AC high voltage power source 92 or 93, by conductors 90 or 91. The other output terminal of AC power source 92 or 93 is directly connected with the output terminal 86 or 87 of AC power source 85 in this example. The corona generating AC high voltage power sources 92 and 93 are intermittent type AC high voltage power sources to supply an alternating voltage only when the corona discharge electrode groups 77 and 78, belonging to the plane plasma generating menas 29 and 30, have a specific polarity, for example, positive polarity. In this arrangement, for example, when the corona discharge electrode group 77 has positive polarity, an alternative voltage is supplied between it and the inductive electrode 88, to cause corona discharge through the insulator from the edges of respective strip-formed electrodes 81 to the insulating board 79, and positive ions only are drawn from the plasma thus generated, into the charging space, toward the other corona discharge electrode group 78, being absorbed by the group 78. However, at this time, since the other corona generating AC high voltage power sources 93 does not supply any output voltage, strip-formed electrodes 82 with negative polarity belonging to the corona discharge group 78 do not produce corona discharge, and hence do not supply negative ions to the charging space 20. When the polarity of main field forming AC power sources 85 is reversed, the operation reverse to the above is obtained, and this time only positive ions are supplied to the space from the corona discharge group 78 with positive polarity. Thus, the field of charging space 20 is alternated periodically like rectangular waves, and always unipolar ions of positive (or negative) polarity shuttle, to bombard the fine particles 96 introduced from the above, to charge the particles. Charged particles are vibrated, receiving alternating coulomb force, and without adhering to electrodes of one direction coulomb force, they are charged powerfully up to the maximum theoretical charged quantity, and are delivered downward for supply.

In this case, the connection from the AC power sources 92 and 93 to the AC power source 85 and the connection to the inductive electrodes 88 and 89 can be made indirectly through a capacitor. In this event, it is preferable to connect a high resistance for leaking off accumulated charges, in parallel with the coupling capacitor.

The inductive electrodes 88 and 89 can be formed as strips instead of sheets, and can be arranged in zigzag positions with corona discharge electrodes 77 and 78 to oppose then through an insulating board. In this arrangement, said inductive electrodes themselves can be used as corona discharge electrodes.

FIG. 13 is a block diagram of a still further embodiment of the present invention. The names and functions of symbols 29 to 96 in FIG. 13 are same as those of the same symbols in FIGS. 3 and 12. In this example, between the respective strip-shaped discharge electrodes 81 and 82, respectively mutually connected to constitute the corona discharge electrode groups, linear (or dotted-linear) auxiliary discharge electrode groups 97,98 and 99, 100 insulated and isolated from the electrodes 81 and 82, are provided, and are isolated from one another. The auxiliary electrodes of the same group are not connected to each other. Opposite to the auxiliary discharge electrode groups 97,98, 99 and 100, strip-shaped inductive electrode groups 101,102, 103 and 104 are provided in parallel respectively on the back sides of insulating boards 79 and 80, as illustrated, and the respective electrodes belonging to each group of 101,102, 103 and 104 are connected mutually, being insulated from each other group, and are connected through a coupling capacitor 105, 106, 107 or 108 and a conductor 109, 110, 111 or 112 to the corona generating AC high voltage power source 92 or 93 as illustrated. Symbols 113 to 116 are high resistances for leaking current. The inductive electrode groups 101 to 104 are embedded in insulators 117 and 118 respectively.

For example, supposing the corona generating AC high voltage power source 92 supplies an alternating voltage only when the corona discharge electrode group 77 has positive polarity, this alternating voltage is supplied through the coupling capacitors 105 and 107 to the inductive electrode groups 101 and 103, and as a result, an alternaiting voltage is applied between the isolated linear auxiliary discharge electrode groups 97 and 99 through said insulating board 79 and the strip-formed discharge electrode group 81, by electrostatic induction. As a result, AC corona discharge is generated between said auxiliary discharge electrode groups 97 and 99 and the edges of said strip-formed discharge electrode group 81, to supply positive ions from there into the charging space 20. If the polarity is reversed, the operation is reversed, to supply positive ions from the discharge electrode group 78 into the charging space 20.

Thus, fine particles are efficiently and safely charged, as mentioned above, but in this case, since the auxiliary discharge electrode groups 97,98, 99 and 100 are provided, AC corona discharge is intensified, to greatly increase the quantity of ions supplied, thereby improving the charging efficiency.

In this case, the auxiliary discharge electrode groups 97 and 99 on one hand and 98 and 100 on the other hand respectively, can be connected by a conductor and the inductive electrodes 101 and 103 on one hand and 102 and 104 on the other hand respectively, can be connected, being connected to the conductors 109 and 110, the other conductors 111 and 108 then being connected to the conductors 83 and 94, for quite the same operation.

The corona discharge electrodes and auxiliary discharge electrodes in the particle charging device of the present invention can be formed as strips, lines, bars, needles or any other proper shapes. The inductive electrodes also can be formed as flat plates, strips, lines, bars or any other proper shapes, and if necessary can be covered with an insulator, to constitute intervening insulators. The discharge electrodes and inductive electrodes can be made by vacuum evaporation of metal, plating, etching, etc. The discharge electrodes and inductive electrodes can be made from not only metals but from any arbitrary conductive or semiconductive materials. Particularly when they are made from any material with sufficient resistance (approx. 10 to 100 MΩ), safety can be improved further since spark discharge energy in the case of dielectric breakdown of insulator can be limited.

The intervening insulators 79 and 80 can be perfect insulators, but can be inorganic insulators with slight conductivity such as for example glass. To protect the discharge electrodes, the top surface can be covered with and inorganic insulator such as glass with proper conductivity. The corona generating AC high voltage power sources 92 and 93 and the main field forming AC high voltage power source can be arranged as one common AC power source, to supply respectively required voltages from the taps provided at the output side of the power source. The main field forming AC high power source 85 can be any source generating symmetrically alternating voltages, but particularly, alternating voltages with symmetrical rectangular waveform are preferable for raising the charging efficiency.

The AC power sources 92 and 93 can be sources to generate given alternating voltages, but power sources to generate alternating voltages with frequency of sufficiently higher than that generated by the AC power source 85 are particularly preferable, since they can increase the amount of ions supplied.

An actually measured charged quantity of particles charged by the present invention device is given as an example. It shows a value close to the theoretical saturation point, attained in a very short time of charging, and proves that the new particle charging device of the present invention has remarkably effective charging performance.

Particle diameter $2a=26\ \mu m$

Theoretical saturation charged quantity $qc=1.237\times10^{-14}(C)$

Measured maximum charged quantity $qmax=1.225\times10^{-14}(C)$

Average charged quantity $q=1.204\times10^{-14}(C)$ $(\bar{q}/qc)\times100=99.0\ (\%)$ Charging time $T=50$ (ms)

The new particle charging device of the present invention allows the charging of any particles, however high resistance they may have, in a very short time safely up to the above theoretical saturation charged quantity, without causing inverse ionization. Therefore it can be used as a particle charging means of two-step electrostatic precipitator which is divided into particle charging means and particle collecting means, with the former placed before the latter. In this case, it has now been proven that high resistance dust, which cannot be charged and collected satisfactorily by any ordinary methods because of inverse ionization generated, can now be perfectly collected. The particle charging device of the present invention can be employed also for electrostatic powder painting. In the application, the device can be combined with a painting gun, for forcefully charging paint particles, or the particle charging device of the present invention itself can be used as a painting machine, to put particles and an object to be painted in it, for painting. In this case, it is preferable to use a main field forming AC high voltage power source with a neutral point provided on the secondary side of the boosting transformer, to be grounded. In this case, the center of the charging space between one pair of said plane plasma generating means has ground potential, and therefore, a grounded object to be painted can safely be inserted in the space to immediately cause the charged painting particles to collide with it, for charging. Furthermore, since the new particle charging device of the present invention can accurately charge particles in proportion to the square of particle diameter and to the field intensity, it can be used as a particle charging means of an electrostatic sorting device to sort with a predetermined particle diameter as a diverging point by the action of the field with the device installed, or of a particular diameter measuring instrument, dust quantity measuring instrument, etc. in this case, very accurate operation and measurement can be made.

As discussed above, the arrangements of the present invention provide the advantages that no complex phase shifters are required, and that there is considerable flexability with respect to the choice of frequencies for the main AC field and for the plasma producing voltages. This is achieved by the use of switching means for controlling the AC exciting voltages, and such switching is readily effected. It is preferable at the period of excitation of the plasma be smaller than a half period of the main voltage, and it should also be located in such half period. Such control, however, is readily effected.

While the invention has been dislcosed and described with reference to a limited number of embodiments, it will be apparent that variations and modifications may be made therein, and it is therefore intended in the following claims so cover each such variation and modification as falls within the true spirit and scope of the invention.

What is claimed is:

1. In a device for electrically charging particles, comprising two or more parallel plane plasma generating means opposite to one another at a determined distance and provided with corona discharge electrodes for charging particles in the intervening space, corona generating high voltage power sources coupled to apply a high voltage alternately to the corona discharge electrodes of said respective plane plasma generating means, for generating corona discharge, and a main field forming AC high voltage power source connected to apply a high AC voltage between the opposing plane plasma generating means, for forming a main AC field in the charging space; the improvement wherein said corona generating high voltage power sources comprise intermittently operative power sources for supplying intermittent high voltages of a frequency at least equal to that of said main field, said corona generating high voltage power sources applying high voltages to the respective plasma generating means to produce corona discharge for thereby generating plasma only when the plane plasma generating means have specific relative polarities, whereby unipolar ions of said polarity are alternately emitted from opposing plane plasma generating means to the charging space therebetween, for charging particles introduced into said space.

2. The device of claim 1 wherein said corona generating high voltage power sources comprise AC high voltage power sources having a higher frequency then that of said main field.

3. The device of claim 1 wherein said corona generating high voltage power sources comprise AC high voltage power sources of the same frequency as that of said main field.

4. The device of claim 1 comprising means for blowing air currents through said plane plasma generating means from the back sides thereof, toward said charging space, for preventing the adhesion of particles to said plane plasma generating means.

5. The device of claim 1 wherein each of said plane plasma generating means comprises a pair of corona discharge electrode groups of parallel closely spaced electrodes, and insulation means between the respective electrode groups, means interconnecting alternate electrodes, and means applying a high voltage from said corona generating high voltage power source between said corona discharge electrode groups.

6. The device of claim 5 wherein each of said plane plasma generating means comprises a corona discharge electrode group and a non-corona discharge electrode group, said corona discharge electrode groups and non-corona discharge electrode groups being parallel to one another, with insulation therebetween, and means applying a high voltage from said corona generating high voltage power source between said corona discharge electrode group and said non-corona discharge electrode group.

7. The device of claim 1 wherein each of said plasma generating means comprises a plurality of corona discharge electrode groups each including parallel closely spaced electrodes, an inductive electrode spaced from said groups, an insulator between said inductive electrode and said groups, and means applying a high voltage from said corona generating high voltage power source between said inductive electrode and the respective corona discharge electrode groups.

8. The device of claim 7 further comprising auxiliary discharge electrodes positioned to oppose said corona discharge electrode groups and adjacent to and insulated therefrom, said auxiliary discharge electrodes opposing said inductive electrode and insulating means between said inductive electrode and said auxiliary discharge electrodes.

9. In a device for electrically charging particles, comprising a pair of parallel plane plasma generators spaced apart from one another to define a particle charging space, each generator including first electrode means for producing a main field in said space, and corona discharge electrodes, a source of high voltage AC connected between said first electrodes, and corona generating high voltage source means coupled to apply high voltages between each first electrode and the respective corona discharge electrodes; the improvement wherein said corona generating high voltage source means comprise means responsive to a determined polarity of high voltage between the respective first electrode and the other generator for intermittently applying a high voltage to the respective corona discharge electrode for producing corona discharge at a frequency at least equal to the frequency of the field in said charging space, whereby only ions of one polarity are driven into said space.

* * * * *